US005979852A

United States Patent [19]

Lévesque

[11] Patent Number: 5,979,852

[45] Date of Patent: Nov. 9, 1999

[54] MULTI-FUNCTION HANGER

[76] Inventor: Micheline M L Lévesque, 215 Grande Allée, Terrebonne, Quebec, Canada, J6W 4S2

[21] Appl. No.: 08/923,426

[22] Filed: Sep. 4, 1997

Related U.S. Application Data

[60] Provisional application No. 60/025,720, Sep. 10, 1996.

[51] Int. Cl.[6] ..... A47H 1/16; B42F 13/00

[52] U.S. Cl. ..... 248/339; 248/303

[58] Field of Search ..... 248/339, 690, 248/692, 48.1, 237, 303, 304, 317

[56] References Cited

U.S. PATENT DOCUMENTS

| | | | |
|---|---|---|---|
| D. 30,108 | 1/1899 | Heib | 248/48.1 |
| 180,817 | 8/1876 | Abbott | 248/48.1 |
| 189,094 | 4/1877 | Gilbert | 248/48.1 |
| 280,639 | 7/1883 | Lipe | 248/303 |
| 338,718 | 3/1886 | De Witt | 248/48.1 |
| 623,369 | 4/1899 | Heib | 248/48.1 |
| 763,449 | 6/1904 | Wolford | 248/48.1 |
| 1,041,750 | 10/1912 | Day | 248/48.1 |
| 2,624,201 | 1/1953 | Thomson | 248/304 |
| 3,140,849 | 7/1964 | Garr et al. | 248/304 |
| 3,240,463 | 3/1966 | Cook | 248/303 |
| 4,603,507 | 8/1986 | Nelson | 47/67 |
| 5,007,609 | 4/1991 | Bredovskis | 248/303 |

FOREIGN PATENT DOCUMENTS

| | | | |
|---|---|---|---|
| B-29775/92 | 2/1993 | Australia | 248/48.1 |

*Primary Examiner*—Derek J. Berger
*Assistant Examiner*—Michael Nornberg
*Attorney, Agent, or Firm*—Eric Fincham

[57] ABSTRACT

There is provided a hanger for mounting on a gutter which in turn is mounted on an eave of a structure, and wherein the gutter has a generally U-shaped cross sectional configuration, the hanger comprising an elongated member having a U-shaped portion sized to fit within the gutter, a stabilizing member joining a first end of the U-shaped portion, the stabilizing portion being designed to abut an underside of the roof, and a shaft portion located at a second end of the U-shaped portion, the shaft portion extending downwardly exteriorly of an outer wall of the gutter, the shaft portion having means thereon to hang an object, a connecting portion connecting the shaft portion to the second end of the U-shaped portion, the connecting portion having an inverted U-shaped configuration. The hanger member is easy to manufacture and may be used for hanging a number of objects such as plants, bird feeders, etc.

6 Claims, 2 Drawing Sheets

1
18
16
14
3
4

18
2
6
9
3
22
24
26
4
7
8

MULTI-FUNCTION HANGER

This application claims benefit of Provisional Application Ser. No. 60/025,720 filed Sep. 10, 1996.

FIELD OF THE INVENTION

The present invention relates to the field of hooks and is particularly concerned with a multi-function hanger for outdoors.

BACKGROUND OF THE INVENTION

A lot of people like to adorn their house with potted flowers. To do so, they often use hooks to hang them. They also hang other items all around their house like hanging baskets, feeders for birds, birdeages and like articles.

It is therefore an object of the present invention to provide a multi-function hanger that is retrievable, secure and does not require any maintenance.

Advantages of the present invention include the fact that the multi-function hanger can easily be installed on different models of gutters and that it is really stable.

Another advantage of the present invention resides in the fact that the multi-function hanger is made of a non-corrosive material in order to allow people to use it outside.

A further advantage of the present invention resides in the filet that different models of multi-finction hangers can be manufactured. In order to please the consumers, the multi-finction hanger can be manufactured in different lengths and colors (with varied decorative effects).

BRIEF DESCRIPTION OF THE DRAWINGS

An embodiment of the invention will now be described, by way of example, in reference to the following drawings in which FIG. 1 In a perspective view, illustrates a multi-function hanger in accordance with an embodiment of the present invention.

DETAILED DESCRIPTION

Figures 1, 2:
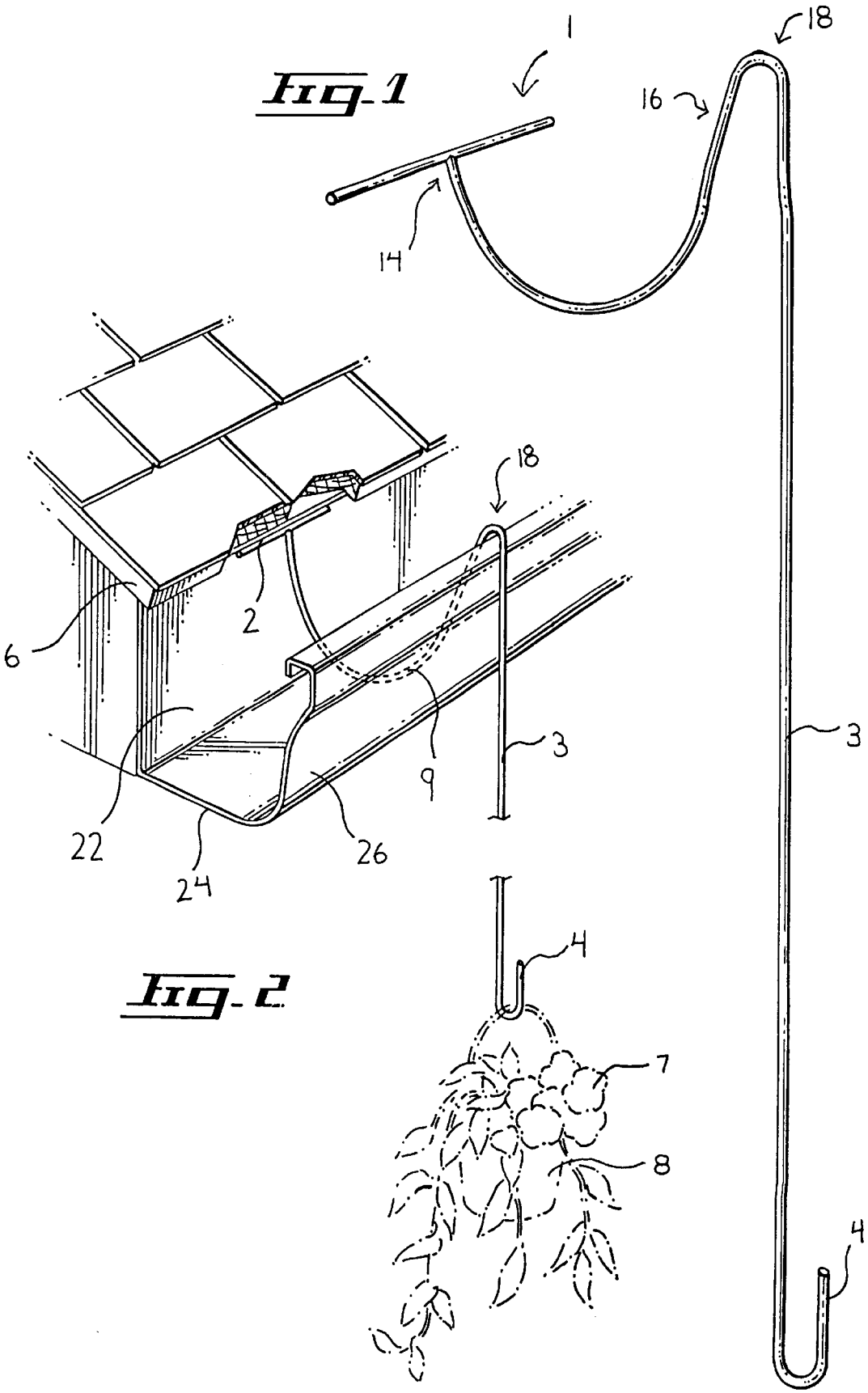
FIG. 2 In a perspective view, illustrates a conventional gutter with a multi-function hangers upper part installed in it in accordance with an embodiment of the present invention.
Figure 3:
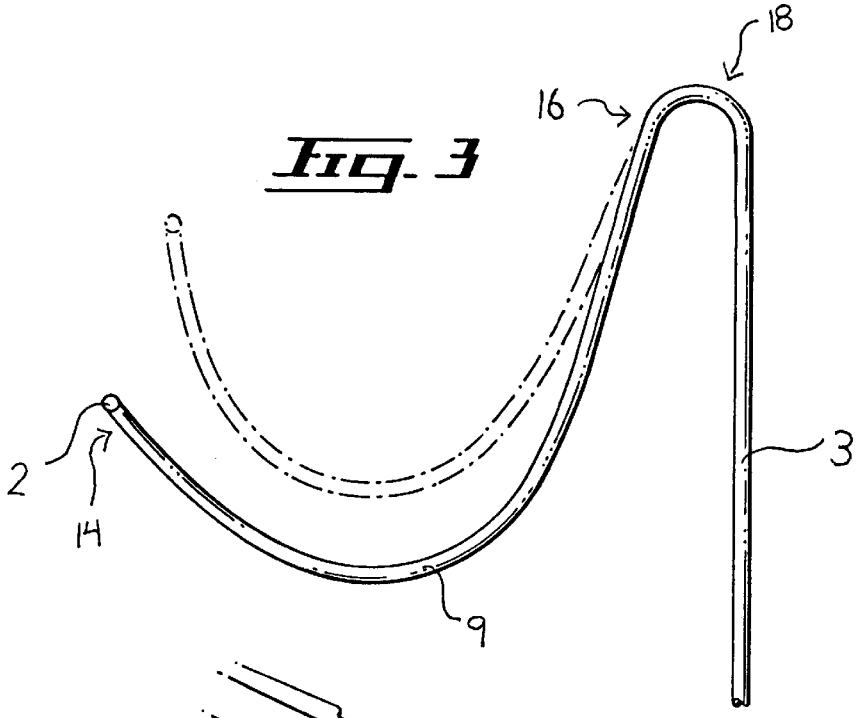
FIG. 3 In a side view, illustrates the flexible bend (that goes in a conventional gutter) of a multi-function hanger in accordance with an embodiment of the present invention.

Referring to FIG. 1, there is shown, in a perspective view, a multi-function hanger 1 in accordance with an embodiment of the present invention.

The multi-function hanger 1 is composed of a stabilizing member 2, a U-shaped portion 9, a shaft 3 and a hook 4. In order to please a majority of consumers, the multi-function hanger 1 can be manufactured in different lengths and colors (with varied decorative effects).

Referring to FIG. 2, there is shown, in a perspective view, a conventional gutter 5 with the upper U-shaped portion 9 of a multi-function hanger 1 installed in it. Gutter 5 includes an inner wall 22, an outer wall 26, and a base 24. The installation of the multi-function hanger 1 is really simple: the stabilizing member 2 has to be placed under the edge of the roof 6 while the U-shaped portion 9 is inserted in the gutter 5. Thus, the stabilizing member 2 abuts the underside of the roof 6 and the U-shaped portion 9 is squeezed in the gutter 5. The stabilizing member 2 acts as a stabilizing portion and is large enough to provide a good stability that allows the multi-function hanger 1 to stay in place even when something is hung to it (for example a hanging basket 8 with flowers 7). U-shaped portion 9 has a first end 14 connected to stabilizing member 2 and a second end 16 connected to shaft 3 by means of an inverted U-shaped connecting portion 18.

Figure 4:
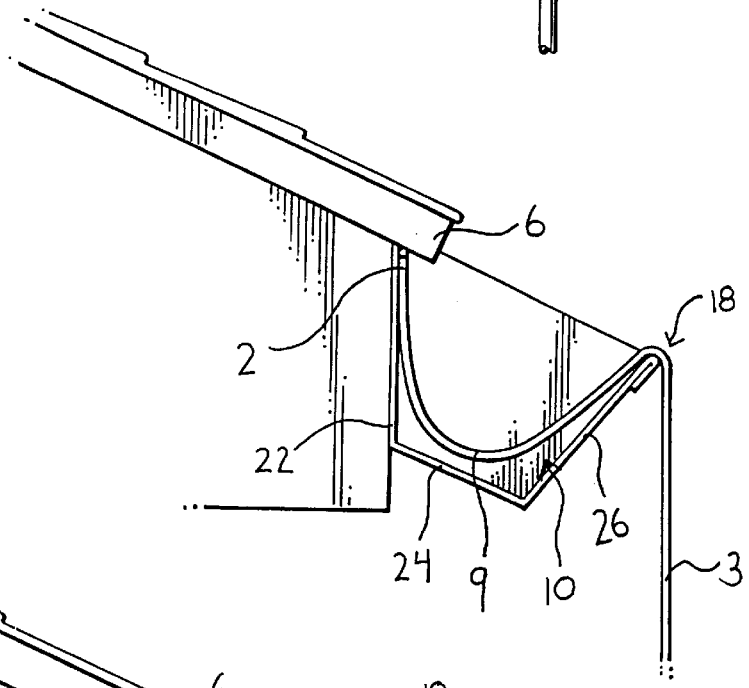
FIG. 4 In a side view, illustrates a conventional gutter with a multi-function hanger's upper part installed in it in accordance with an embodiment of the present invention.
Figure 5:
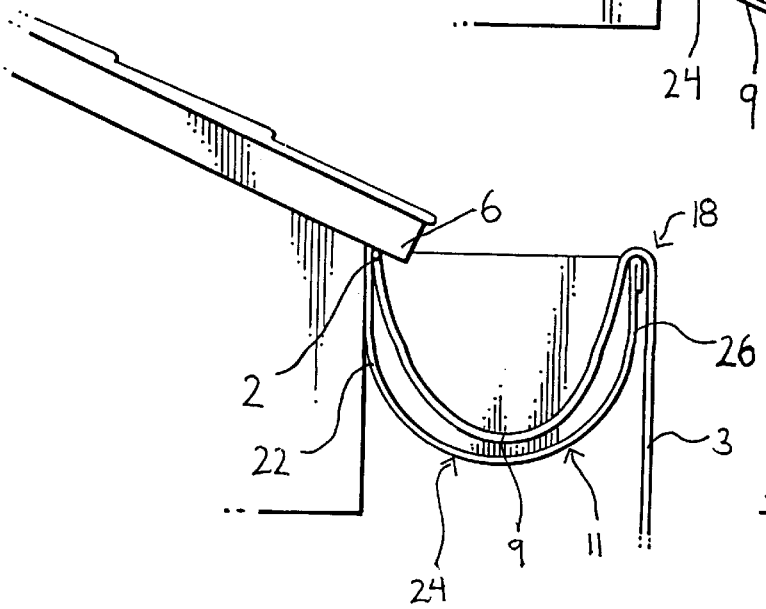
FIG. 5: In a side view, illustrates a different model of a conventional gutter with a multi-function hanger's superior part installed in it in accordance with an embodiment of the present invention.

Referring to FIG. 4 and 5, there is shown how the multi-function hanger 1 is adaptable to different models of gutters. The upper U-shaped portion of the multi-function hanger 1 fits as well in the conventional gutter 10 as in the gutter 11.

In a preferred method of manufacturing, the multi-function hanger is made of a non-corrosive material like P.V.C. (polyvinyl chloride). Any other suitable materials such as polypropylene could be used without departing from the scope of the present invention.

Various embodiments of the invention are disclosed in FIGS. 1 through 5. It should be understood that all such embodiments rely on the same basic structure and that various modifications, adaptations and variations may be made to the specific embodiments of the invention herein disclosed without departing from the scope of the present invention.

The embodiments of the invention in which an exclusive privilege or property is claimed are defined as follows:

1. In combination, a hanger and a gutter adapted to be mounted on an eave of a structure;

said gutter having a generally U-shaped cross sectional configuration defined by a base, an inside wall designed to lie adjacent to said cave and under a roof, and an outer wall;

said hanger comprising an elongated member having a U-shaped portion sized to fit within said gutter; said U-shaped portion having a first arm and a second arm, said first arm lying proximate said inside wall of said gutter and interiorly within said gutter, said second arm lying proximate said outer wall of said gutter;

a stabilizing portion joining a first end of said U-shaped portion, said stabilizing portion adapted to abut abutting an underside of said roof;

a shaft portion located at a second end of said U-shaped portion, said shaft portion extending downwardly exteriorly of said outer wall of said gutter, said shaft portion having means thereon to hang an object;

and a connecting portion connecting said shaft portion and said second end of said U-shaped portion, said connecting portion having an inverted U-shaped configuration.

2. The combination of claim 1 wherein said hanger is formed of a plastics material.

3. The combination of claim 2 wherein said hanger is formed of a polyvinyl chloride.

4. The combination of claim 1 wherein said means on said shaft portion to hang an object comprises a hook.

5. The combination of claim 1 wherein said U-shaped portion, said shaft portion and said connecting portion lie in a single vertical plane.

6. The combination of claim 1 wherein said stabilizing portion comprises a stabilizing member extending substantially perpendicular to said single vertical plane.

* * * * *

UNITED STATES PATENT AND TRADEMARK OFFICE

CERTIFICATE OF CORRECTION

PATENT NO. : 5,979,852

DATED : November 9, 1999

INVENTOR(S) : Micheline M L Levesque

It is certified that error appears in the above-identified patent and that said Letters Patent is hereby corrected as shown below:

On the title page, item [76], change:

Micheline M L Lévesque to Micheline Lévesque

Signed and Sealed this

Sixteenth Day of May, 2000

*Attest:*

Q. TODD DICKINSON

*Attesting Officer*

*Director of Patents and Trademarks*